United States Patent [19]

Stockdale

[11] 4,191,948

[45] Mar. 4, 1980

[54] DIGITAL TRANSMISSION APPARATUS PARTICULARLY ADAPTED FOR SECURITY SYSTEMS

[75] Inventor: Roy Stockdale, Huntington, N.Y.

[73] Assignee: Napco Security System Inc., Copiague, N.Y.

[21] Appl. No.: 953,482

[22] Filed: Oct. 23, 1978

[51] Int. Cl.[2] ..... G08B 3/10

[52] U.S. Cl. ..... 340/539; 325/64; 325/141; 325/325

[58] Field of Search ..... 340/167 R, 506, 517, 340/531, 539; 325/37, 38 R, 39, 64, 141, 325

[56] References Cited

U.S. PATENT DOCUMENTS

| | | | |
|---|---|---|---|
| 4,027,276 | 5/1977 | Shaughnessy | 340/539 |
| 4,032,848 | 6/1977 | Shaughnessy | 340/539 |

*Primary Examiner*—Alvin H Waring
*Attorney, Agent, or Firm*—Arthur L. Plevy

[57] ABSTRACT

A digital transmission system comprises a transmitter and a receiver for use in a security system. An alarm code is set by means of switches in both the transmitter and receiver and is indicative of the address or location of a monitored location. The location as monitored contains a sensor which is in either an opened or a closed condition indicative of a secure or unsecure status. The transmitter operates to transmit a digital code for each change in the status of the loop. The code contains bits which define the alarm code or address, while additional bits define the loop status as opened or closed in conjunction with the condition of a battery which is used to power the transmitter. The receiver is adapted to receive the transmitted signal and is operative to compare the transmitted address with the code stored or programmed by the receiver switches. If a valid code is received within a predetermined interval, the receiver operates to decode the loop status by means of an updown counter. If the loop has been opened and closed the same number of times, the updown counter will indicate a secure position at the end of the day. The receiver also contains circuitry to monitor the battery status as transmitted within the code and to sound an alarm if the battery condition falls below an acceptable value. Due to the large number of possible code combinations and due to the modulation scheme employed, the system provides discrimination between other transmission systems operating within the area.

14 Claims, 4 Drawing Figures

DIGITAL TRANSMISSION APPARATUS PARTICULARLY ADAPTED FOR SECURITY SYSTEMS

BACKGROUND OF INVENTION

This invention relates to a digital transmission system employing a transmitter and a receiver and more particularly to such a system employed or incorporated with a security system, such as a fire and burglar alarm apparatus.

The prior art is replete with a number of systems which are referred to as wireless systems. Essentially, such sustems are used as automatic garage door openers, remote control and so on. These systems transmit a unique code which consists of a predetermined number of bits arranged to provide a unique address to therefore enable the receiver to discriminate against various signals in order to only respond to the correct signal. In the case of a garage door for example, one would desire only to open the correct door and not other doors which may employ similar components.

Such wireless systems have been employed in the security field and serve to transmit a unique address when premises which are monitored indicate an intrusion. The advantage of such wireless systems is apparent as they eliminate the necessity for hard wired connections to a monitoring location. The elimination of such hard wiring is particularly advantageous in regard to urban residences and commercial establishments.

In regard to a security system, the apparatus which transmits a digital signal via a transmitter has to be reliable in order to permit accurate determination of an intrusion condition, thereby enabling a proper response. Preferably, the system should be economical to manufacture and relatively simple in operation so that it can be easily maintained and provided for.

Based on the nature of such systems, it is further desirable to monitor the status of an intrusion loop which may include both fire and burglar detectors to determine whether or not the loop is secure and hence, whether or not a true intrusion is present. Upon detection of such an intrusion, the system will transmit a unique code indicative of the premises which are monitored to enable a receiver to respond to the alarm condition and hence, to notify the proper authorities of the intrusion. Transmitting apparatus should be self-contained so that it may be employed at any desired location, such as a window, a door, or some other area which is to be monitored. Preferably, the system should be battery operated and provide an indication of the battery strength to enable replacement of batteries when the voltage falls below a predetermined level.

As indicated, many systems exist in the prior art which employ digital wireless control signals comprising different modulation techniques in an attempt to implement a reliable and accurate apparatus. Many of these techniques incorporate a form of pulse width modulation wherein the width of a pulse is varied according to whether or not the signal to be transmitted is a 0 or a 1. Other systems employ frequency shift modulation to enable a suitable response. As indicated, the majority of such systems are employed as in garage door activation schemes, remote radio control, and other types of control apparatus.

It is an object of the present invention to provide a digital wireless transmission system which is adapted to operate with an intrusion system to enable the transmission and reception of a suitable code signal when a monitored premises is intruded upon. The system to be described is simple to operate and economical to manufacture, while providing a continuous monitoring of the status of the premises and suitable indications of the battery condition at the transmitter.

BRIEF DESCRIPTION OF PREFERRED EMBODIMENT

An information signaling system for a transmitter and receiver to enable a selected receiver to respond to one of a plurality of transmitters comprising a transmitter capable of transmitting an RF signal containing a binary code having a first interval indicative of a signal start condition, and followed by a series of pulses of relatively equal time durations with said durations less than said start interval, with certain of said pulses indicative of a binary one containing a higher frequency tone within said time duration, means located at said transmitter for selecting an address code; which code is specified by said series of pulses, a receiver tuned to said RF signal and including means responsive to said start interval to cause said receiver to store said series of pulses, means located at said receiver for selecting said code associated with said transmitter and for comparing said code as selected with said series of pulses as stored to provide an output signal upon a favorable comparison, said receiver including means responsive to said higher frequency tone indicative of said binary one to enable said receiver to store said pulses as a binary code consisting of a series of ones and zeroes.

DETAILED DESCRIPTION OF INVENTION

Figure 1:
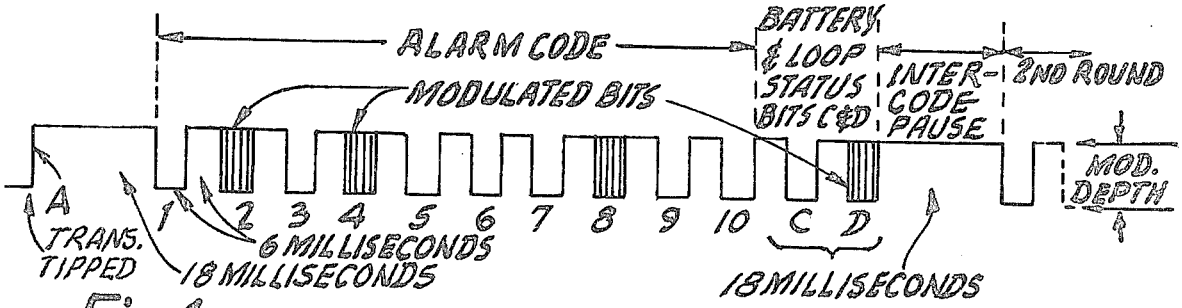
FIG. 1 is a timing diagram showing a particular modulation scheme which is employed according to this invention.

Referring to FIG. 1, there is shown one particular code format which can be employed to represent one of the many address locations. The format of the code will be described in reference with FIG. 1 and from the description, it will be understood that the time levels indicated as well as the number of bits can be modified depending on the requirements of the particular system.

Essentially, the start of the code is initiated at point A of FIG. 1 by the activation of the transmitter. When this occurs, a predetermined delay is implemented before the first bit (1) of the alarm code is generated. The delay in this particular example may be approximately eighteen milliseconds.

The alarm signal then consists of ten bits designated as 1 through 10. These ten bits are code bits and serve to designate the origin of the alarm. Hence, as can be seen, the ten bits can be all zeroes or all ones at an extreme condition and can be combinations of ones and zeroes to enable the generation of $2^9$ unique addresses. Thus, a ten bit system could accommodate that many subscribers.

It will, of course, be understood that the formation of an alarm code employing ten bits is by way of example and one could implement more or less bits depending upon the number of subscribers the system is to service.

Each bit is approximately six milliseconds wide and is followed by a six millisecond space. A binary 1 is defined by a modulation of the bit at an audio level. Referring to bits 2, 4, and 8 of FIG. 1, one can see that each bit is indicative of a binary 1 as it exhibits modulation within the six millisecond width of an audio signal. The modulation is a square wave modulation and can occur at a frequency approximately equal to three times the repetition rate of the total signal. Suitable modulation frequency may be about 600Hz.

Following the ten alarm code bits are two further bits designated as C and D. As will be explained, the two bits C and D can define four unique conditions and basically serve to monitor the status of the loop and the condition of the battery employed at the transmitter. Hence, 00 in bits would indicate a low battery condition, a 01 would indicate an opened loop, while a 10 will indicate a closed loop. It is, of course, understood that the above assignments are arbitrary and any other combination could be employed as well.

The D bit is followed by an intercode pause which is again a delay of about eighteen milliseconds which follows the transmission of the alarm code and the battery and loop status bits. It will be explained that the particular code as shown in FIG. 1 is sent a plurality of times indicative of a full transmission. Each code sequence as above described lasts one hundred ninety-two milliseconds and basically consists of the bits as indicated in FIG. 1. In order to implement a full transmission, the transmitter according to this invention will transmit five code sequences indicating a full transmission of nine hundred sixty milliseconds.

From the above description of the code, it should be obvious that many variations can be employed. Hence, the start and end delays can vary in time and be different than eighteen milliseconds for example, or they may be modulated. It is, of course, seen that the number of bits can vary as well as the frequency and division ratios.

It is, of course, a primary objective of employing a code to enable simple operation at a receiver without the need for transmitting complicated sychronizing signals. While the format shown in FIG. 1 is suitable for system operation to be described, it is also understood that alternate methods of modulation such as a bi-phase scheme can be employed as well. The primary objective of the particular modulation scheme is to enable reliable transmission of the alarm code (bits 1–10) and the loop and status condition (bits C and D) without employing complicated modulation schemes requiring accurate synchronization between the transmitter and the receiver.

Figure 2:
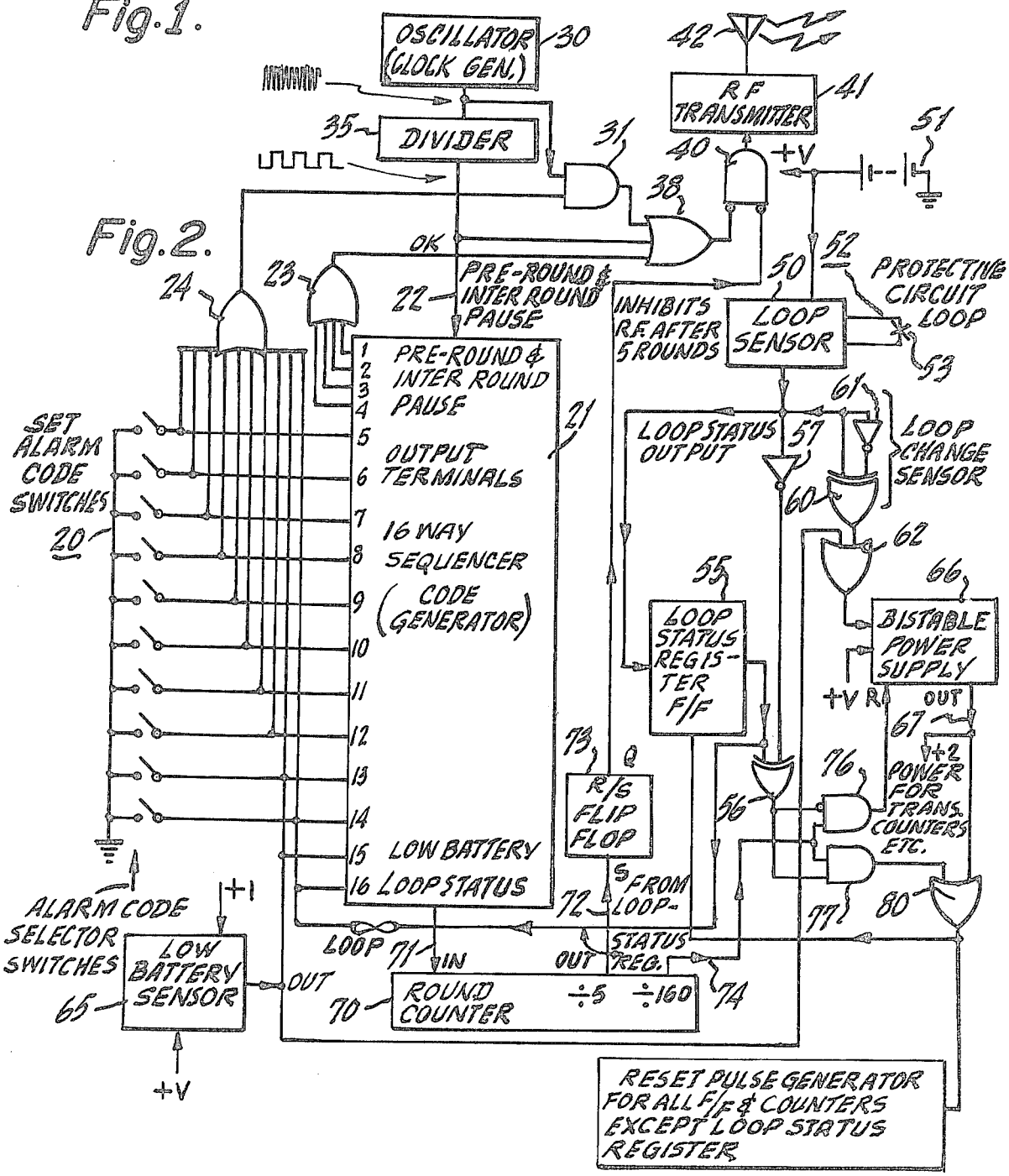
FIG. 2 is a block diagram of a transmitter according to this invention.

Referring to FIG. 2, there is shown a block diagram of a digital transmitter which is operative to generate a code signal as depicted and described in conjunction with FIG. 1. A plurality of switches 20 are shown. As seen, there are ten switches; each of which is a single pole, single throw configuration. One terminal of each switch is connected to a source of reference potential, while the other terminal is connected to a suitable input of a sequencer or code generator module 21.

The switches 20 represent the particular alarm code which is selected by the selective operation of the switches in order to indicate a unique code having a predetermined number of binary ones or zeroes. Closing of one or more of the switches in the array of switches 20 indicates a binary 1, while opening a switch indicates a binary zero.

The sequencer 21 is basically a binary scanner and will produce a series of pulses at its output terminals designated as 1 to 16 according to an input clock applied to its clock terminal 22. Such sequencing devices are well known in the art and for example, may comprise a binary counter having sixteen stages with suitable decode gates. Hence, there is provided at the outputs 1–16 a pulse of a predetermined width; (in this example, six milliseconds).

The bits designated as 5–14 are the alarm code bits shown in FIG. 1 as 1–10. The selection of a binary 1 or a binary 0 as above indicated, is implemented by the closure of a suitable switch. The outputs 15 and 16 of the sequencer 21 are indicative of the bits C and D which define the battery status and loop status as described in conjunction with FIG. 1.

The first four bits designated as output terminals 1–4 are coupled to the input of an OR gate 23 and are operative to generate the initial delay which as shown in FIG. 1, is the delay which commences after the activation of the transmitter. Similarly output bits 5–16 of the sequencer 21 are coupled to the input of an OR gate 24 and hence, the OR gate 24 will pass a suitable pulse indicative of the time slot assigned to one of the switches when that switch is closed or indicating a binary 1.

An oscillator or clock generator 30 is shown and provides a relatively high frequency signal for modulating a particular binary 1 bit. The output of the clock generator is coupled to one input of an AND gate 31. The other input from AND gate 31 is derived from the OR gate 24. As can be seen, each time the OR gate 24 passes a pulse indicative of a binary 1, the AND gate 31 will operate to modulate that pulse with the oscillator 30 signal.

The output of the oscillator 30 is also coupled to a divider 35. Divider 35 may be a binary divider and serves to provide the clock signal to the sequencer 21 to enable the generation of the six millisecond pulses indicative of the alarm code and the battery and loop status bits.

The output of the divider 35 is also coupled to one input of OR gate 38. The OR gate 38 also receives the output of the AND gate 31 at another input thereof and the output of the OR gate 23 at still another input.

The output of the OR gate 31 is coupled to one input of an AND gate 40. The output of AND gate 40 is coupled to the input of an RF transmitter amplifier 41 which drives an antenna 42 to enable transmission of the modulated code of FIG. 1 and as generated by the above described circuitry.

It is, of course, apparent and obvious on how the code shown in FIG. 1 can modulate a suitable RF carrier and details of such modulation are fully understood and known to those skilled in the art.

Shown in the FIG. is a loop sensor circuit 50. The circuit is energized by means of a battery 51; which battery is employed as a biasing source for the transmitter circuitry as described above. Essentially, the loop sensor is associated with a security loop 52 which contains one or more sensor devices 53. Essentially, a sensor device as 53 is a switch and can be normally opened or normally closed depending upon the status of an item to be monitored.

For example, assume that the transmitter of FIG. 2 is to monitor the status of a door and for purposes of explanation, assume that the door is the only item which is to be monitored by the transmitter circuitry described herein. Hence, sensor 53 may incorporate a magnetic contact switch which is conventionally employed in the security industry. Therefore, when the door is closed, switch 53 is also closed indicating that the loop is secure. When the door is opened, switch 53 is open indicating that the system is not secured. The loop sensor 50 monitors the status of the loop and is operative to detect an opened or a closed circuit condition and to provide at its output, a suitable signal indicative of the loop status. Such loop sensor devices as 50 are well known in the security art.

The output of the loop sensor is directed to the input of a loop status register or flip/flop 55. The flip/flop 55 will activate for each change in loop status and hence, will trigger each time the loop sensor 50 indicates a transistion of the loop from a closed to an opened position.

An output of the flip/flop 55 is also directed to one input of an NOR gate 56. The other input to gate 56 is derived from an inverter 57 having its input coupled to the output of the loop sensor. The loop sensor also has its output coupled to one input of an NOR gate 60. The other input to NOR gate 60 is derived from an inverter 61 also having an input coupled to the loop sensor output.

The gates 60 and 61 provide a loop change indication and hence, provide an output signal each time the status of the loop sensor 60 changes from an opened to a closed position. The output of gate 60 is coupled to one input of an OR gate 62. The other input of gate 62 is derived from a battery sensor module 65. The battery sensor module 65 may be a Schmitt trigger or similar device and operates to provide an output when the battery voltage (+V) falls below a predetermined level. This signal will serve, as will be explained, to activate gate 62 to cause the low battery condition to be transmitted and hence, received so that the control location can effectuate a battery change when necessary.

The output of gate 62 is coupled to the set input of a bistable power supply 66. Hence, upon activation of the supply 66 via gate 62, power is supplied via the output 67 to the transmitter components such as the sequencer 21 and the associated gates to thereby enable operation of the same when the bistable power supply is energized.

A further counter 70 is shown in FIG. 2 and is designated as a round counter. The counter 70 receives an output pulse from the sequencer 21 via line 71. Each time the sequencer 21 initiates a full round or a full signal for transmission, the round counter advances one count. At the end of five rounds, the divide by five output 72 activates a flip/flop 73. The flip/flop 73 has its output coupled to the other input of AND gate 40 and inhibits AND gate 40 after five complete signals have been transmitted. Hence, as can be seen, after the transmission of five complete rounds or a full transmission of nine hundred sixty milliseconds in this example, gate 40 as inhibited by flip/flop 73 ceases transmission by turning off the RF transmitter 41.

In any event, the counter 70 also has an output designated as divide by one hundred sixty. The sequencer continues to operate but nothing is transmitted. At one end of thirty seconds, the output of the round counter 70 is applied via lead 74 to the inputs of AND gates 76 and 77. The other inputs of AND gates 76 and 77 are derived from the gate 56. At the end of the thirty second interval as provided by the round counter 70, the bistable power supply 66 is reset. Gate 80 is also activated via gate 77 and serves to reset all the flip/flops and counters in the transmitter at the end of thirty seconds, except the loop status register. The loop status register will only be reset by gate 80 if the loop status changed during the transmission. However, if this occurs, then the change will be indicated at the end of the thirty second inhibit since the pulse generated at the output of gate 80 will serve to again trigger the loop status register 55 at the end of this interval. If the loop status register changed during transmission, the sequencer and transmission will again occur and the transmitter will again be activated to transmit another five rounds of signals and again be inhibited for another thirty seconds.

Figure 3:
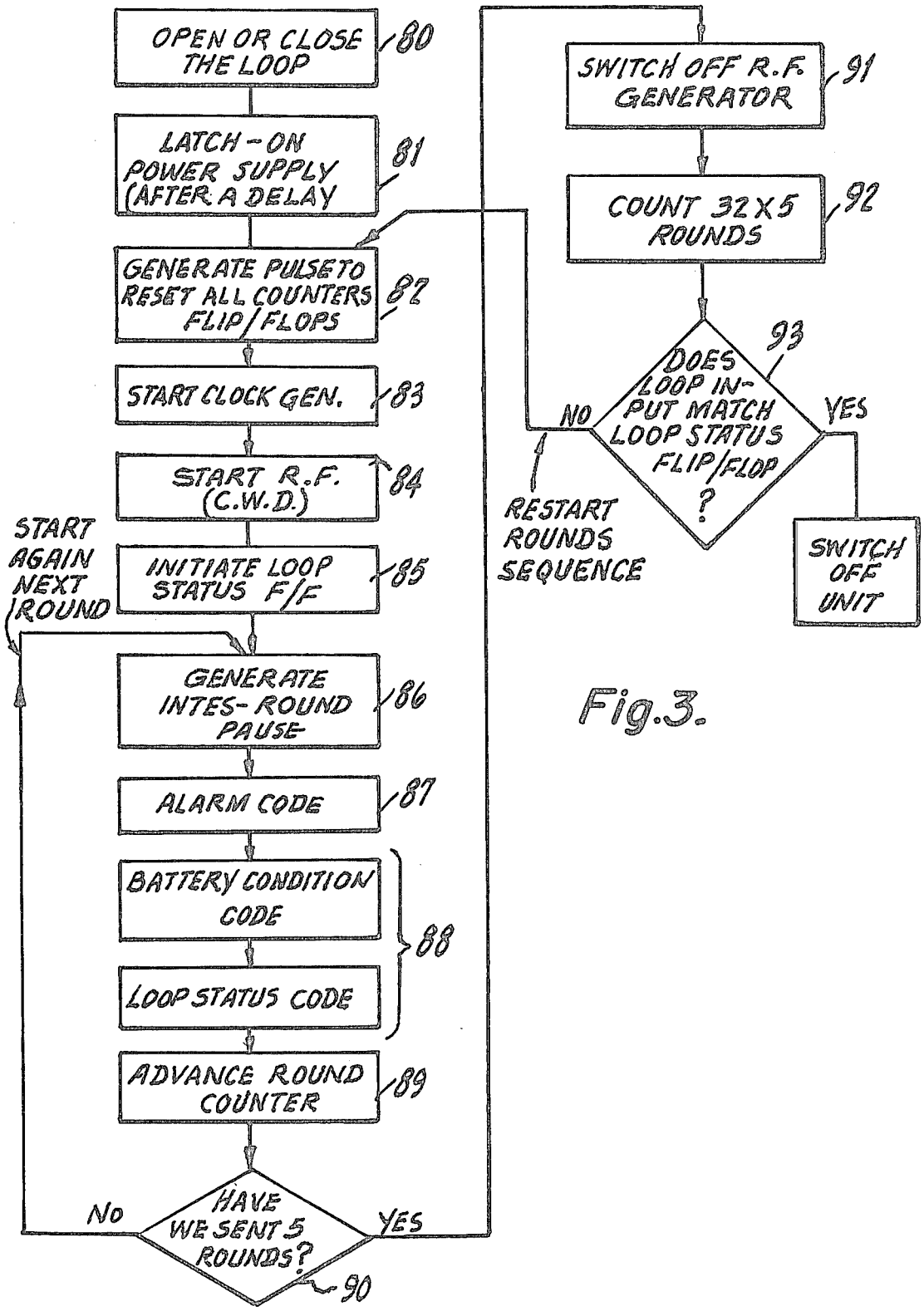
FIG. 3 is a flow chart necessary to explain the operation of FIG. 2.

Referring to FIG. 3, there is shown a flow chart which will be referred to in gaining a still clearer understanding of the transmitter apparatus briefly described and outlined in conjunction with FIG. 2.

The first sequence that the system implements is shown in module 80 and designated as an opened or closed loop. Basically, if the loop is opened or closed, the gates 60 and 61 detect this condition and serve to set the bistable flip/flop or power supply 61. This occurs each time the loop condition changes and this function is indicated by module 81 of the flow chart.

When the bistable supply is set, power is applied via lead 67 to the transmitter components. Gate 80 is activated to reset all the counters such as 70,73,21 to their initial condition as evidenced by module 82. The clock generator 30 and the divider 35 are also allowed to operate as indicated by module 83. The RF generator 41 will also be enabled due to the fact that the flip/flop 73 is reset (module 84).

The loop status flip/flop 55 is set to the proper state depending upon whether the loop was opened or closed. If the loop is closed, a binary zero at the output of the loop status register 55 is applied to the output terminal 16 of the sequencer 21 to thus denote binary zero. Similarly, if the loop was opened, the loop status register would send a binary 1 to the sequencer 21. This is depicted by module 85 of FIG. 3.

The operation commences as shown in the flow chart by first generating the interround pause or delay via gate 23, (module 86). The alarm code is then generated in sequence and provides the binary bits as selected by the switches 20 associated with the output 5 to 14 of the sequencer 21 (module 87). The bits C and D which are indicative of the battery condition and the loop status code, then follow. It is noted that if the battery sensor is in a low state, the unit will transmit the 00 condition for bits C and D and hence, the receiver will immediately detect this and send an alarm indicating low battery. It is also noted that the low battery condition may not necessarily preclude an alarm operation as one could also employ a 11 indication for bits C and D to notify the receiver that there is both an alarm and a low battery condition.

The code as shown in FIG. 1 is generated and transmitted five times and at the end of each transmission, the round counter 70 advances once (module 89). When the round counter indicates a count five, the transmission is complete (module 90) and the RS flip/flop 73 is triggered, thus inhibiting gate 40 and hence, inhibiting RF transmission (module 91).

The round counter continues to count and upon counting thirty-two complete rounds or approximately thirty seconds, the round counter activates output 74 which may serve to reset the bistable 66 and generate a reset pulse via gate 80. If the loop has not changed status, gate 56 will permit the bistable power supply 66 to be reset as both the inputs and outputs are the same and gate 56 will also permit gate 80 to be activated to thence reset the system and hence, switch off the entire unit.

As can be seen, if the loop status register has not changed during the thirty seconds, the entire unit is switched off and is now ready to initiate another transmission upon a change in the loop status register (module 93).

If the loop status register has changed during the transmission, gate 56 will inhibit the resetting of the bistable power supply 66 but will enable gate 80 to reset all counters and flip/flops except the loop status register as indicated by module 82 to again start a new transmission at the end of the thirty second period.

Thus, the transmitter shown has the ability to send two consecutive signals, each consisting of five rounds of the code. The first transmission could then show an opened loop followed thirty seconds later by another transmission showing that the loop has been closed and this operation can continue indefinitely. Thus, the system has the ability to show the opened loop and closed loop status of the door as evidenced by contact 53 which is being monitored.

It is, of course, understood that the number of code rounds, which in this example is five, could be varied accordingly and could be more or less. The reason for sending five or a plurality of such codes is to assure that the receiver will function to recognize and decode the information by making a comparison for example of two out of five or three out of five transmissions. This is done to increase the reliability by transmitting a redundant signal and relying on the fact that the receiver only has to detect two identical signals in order to ascertain proper operation. Based on power levels and noise conditions, the probability associated with such detection assures reliable operation.

It is also seen that the low battery sensor 65 can cause the independent tripping of the bistable power supply via gate 62 and hence, if the battery condition is low, the unit can be activated via the sensor 65 to transmit a signal indicative of low battery condition.

It is, of course, understood that many options are available from the above described technique and as indicated above.

The transmitter described operates within FCC requirements in that a complete round of five signals is always sent for less than one second (i.e. 960 milliseconds), and there is no RF transmission until thirty seconds after the first transmission. This is imposed by the FCC and as can be ascertained, the above described transmitter operates within those limitations which exist according to FCC requirements.

Figure 4:
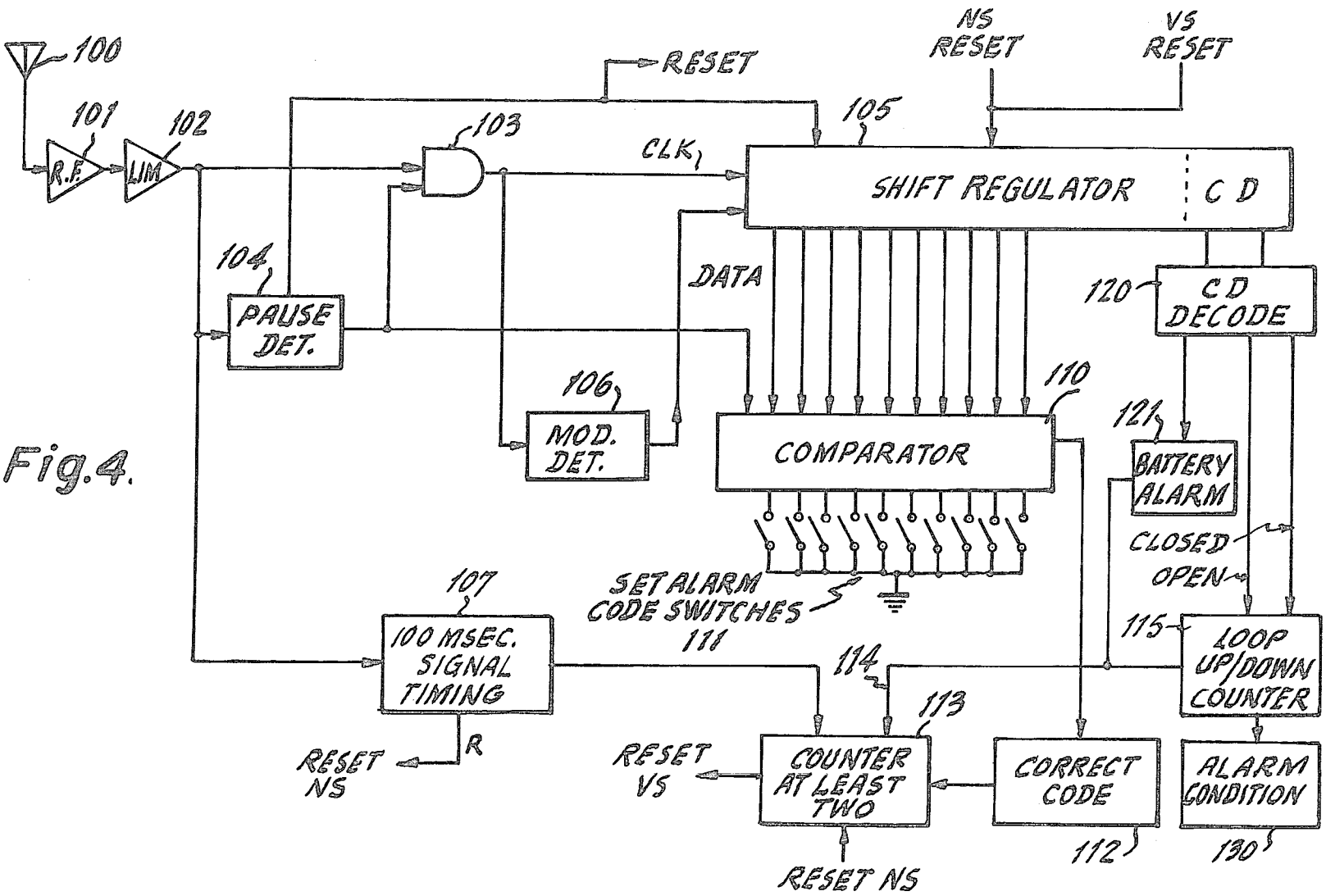
FIG. 4 is a block diagram of a receiver employed in this invention.

Referring to FIG. 4, there is shown a block diagram of a receiver schematic which will operate with the transmitter shown in FIG. 2 and operates according to the signal characteristics shown in FIG. 1. It is, of course, understood that there are many alternate ways which will be apparent to those skilled in the art in implementing the receiver function to be described. It is therefore understood that the receiver as depicted in FIG. 4 is an example of a suitable unit.

The receiver includes a receiving antenna 100. Antenna 100 is coupled to the input of RF amplifier 101 which serves to amplify the receiver signal to a suitable level and also operates to provide a demodulated representation of the transmitted signal as shown in FIG. 1. Techniques for removing the RF to derive the modulation are well known within the state of the receiver art and it is deemed that module 101 includes suitable demodulation circuitry to retrieve a replica of the transmitted signal information according to FIG. 1.

The output of the RF amplifier is coupled to the input of a limiter circuit 102. The function of the limiter is to square off the amplified signal to achieve relative sharp rise and fall times for the transmitted signal as depicted, for example in FIG. 1. The output of the limiter is coupled to one input of an AND gate 103 and is coupled to the input of a pause detector circuit 104. The pause detector circuit 104 has one output coupled to the other input of AND gate 103 and another output coupled to a reset input of a shift register 105. The function of pause detector 104 is as follows:

The pause detector responds to the interround delay or pause associated with the transmitted signal as shown in FIG. 1. As indicated, the interround pause or delay is approximately eighteen milliseconds as is the intercode pause at the termination of the signal. It is noted that the alarm code always follows an eighteen msec. delay as determined by the interround delay or the intercode pause at the beginning and end of the signal.

The pause detector provides a first signal after detection of a suitable interval, say ten milliseconds. At the end of the ten millisecond interval, the shift register 105 is reset to all zeroes. At the termination of the interround delay or pause or at the end of the eighteen millisecond period, the pause detector then provides a gating pulse of a sufficient duration to open gate 103 for the twelve information bits to follow which are the alarm code bits and the battery condition and loop status bit. There are many techniques for implementing pause detector 104 as by cascaded one-shot circuits or suitable counting and gating apparatus.

Essentially, the pause detector provides a reset signal after it has detected a constant level for at least ten milliseconds which is greater than the six millisecond bit transmissions. It then produces a gating pulse of a sufficient duration to enable the shift register 105 to receive the alarm code and data bits C and D.

The shift register 105 has its clock input taken from the output of gate 103. The output of gate 103 is also coupled to a modulation detector 106. The modulation detector 106 functions to demodulate the audio frequency indicative of a binary 1.

For example, as shown in FIG. 1, bits 2,4,8 and the D bit are shown modulated. The modulation detector detects the modulation on these bits and provides an output pulse train which consists of positive data bits at the location, for example of bits 2,4,8 and D. The output of the modulation detector is applied to the data input of the shift register 105. Hence, at the end of a transmission, the shift register will have stored therein, the exact alarm code in terms of binary ones and zeroes as well as the status of the C and D bits indicative of loop status and battery condition.

The ten stages of the shift register which are indicative of the alarm code are coupled to the ten input lines of a comparator 110. The comparator 110 has an additional ten input lines which are coupled to a bank of ten alarm code switches 111. The alarm code switches 111 are set exactly as the alarm code switches 20 of the transmitter depicted in FIG. 2. Hence, the receiver will be responsive to receive an alarm code as selected by the setting of the switches 20 in the transmitter and the switches 111 in the receiver associated with the comparator 110. Hence, during a round, the shift register will have the correct alarm code and the comparator will indicate that the correct code has been received.

The pause detector 104 supplies the comparator with the reset pulse which it generates during the intercode pause to determine whether or not the alarm code was correct. If the alarm code was correct, an output signal is produced as exemplified by module 112 and this output signal sets a counter 113.

It is, of course, seen that at the termination of the bit transmission, the intercode pause again occurs. The pause detector 104 operates again to reset the shift register and to generate another gating pulse for gate 103. Hence, the second round of bits which should be the same as the first round, are again transferred to the shift register 105 at the end of the second transmission. The comparator is again interrogated and if an alarm code coincides, counter 113 will be set to the count of two. The reception of two identical alarm codes indicates a valid transmission.

The counter 113 then sends a gating signal via line 114 to an updown counter 115. The updown counter 115 is operated by the C,D bits contained in shift register 105. The C,D bits as above indicated are indicative of the loop status and the battery condition. The bits are decoded by a binary decoder 120 which is a set of AND gates for decoding the binary conditions associated with low battery and opened and closed loop. If a low battery condition is detected, a low battery alarm 121 is activated thus informing the receiver of the low battery condition.

The decoder 120 will also operate to advance the loop counter one count for an opened loop and to decrease the loop counter by one count for a closed loop. Hence, the system depicted continuously monitors the opening and closing of the loop as indicated by the opening and closing of contact 53 of FIG. 1. If the loop has been opened and closed the same number of times, the updown counter will indicate a zero at the end of the day. The presence of a zero in the updown counter indicates a closed loop condition. If the loop is then opened, the updown counter will indicate a 1 and hence, inform the user that the loop has been closed and opened. This constitutes an alarm condition and can be further implemented by a suitable alarm circuit 130.

It is noted that both the receiver and the transmitter operate entirely according to digital techniques. For example, a binary 1 as shown in FIG. 1 is represented by high frequency modulation within the six millisecond pulse duration. The modulation detector 106 can therefore comprise a counter. The counter is gated for six milliseconds and counts transmissions which occur during a six millisecond period. If the transmissions exceed a predetermined amount, then the modulation detector specifies that this six millisecond period is, in fact, a 1 and a binary 1 appears on the data line to the shift register 105.

For example, one may modulate the six millisecond pulse with a frequency which is eight to ten times greater than the repetition rate of the pulses and hence, the modulation detector will count eight times during the six millisecond period, which count is indicative of a true binary 1. However, noise may be present on the signal but it is unlikely that noise will produce the minimum number of transmissions required to determine the presence of a 1. Hence, any transistions which are less than for example, three, during the six millisecond period, will be decoded as a zero. If the transmissions counted by the modulation detector are greater than, for example three, then this will be determined as a 1.

In this manner, it is seen that one need not fully modulate the entire six millisecond pulse, but may modulate the center of the pulse and these transistions may be detected by the detector 106. In this manner, a one-shot may be triggered during the start of each pulse and the counter be employed to count transistions during the duration of the one-shot and hence, can discriminate between a zero and a one by assuring that a predetermined number of transistions within the six millisecond period is, in fact, a binary 1.

When the counter 113 indicates two correct transistions have occured, it serves to reset the shift register to allow for a next transmission. The counter 113 is also automatically reset after a predetermined period by an interval timer after decoding two correct transmissions. Hence, as can be seen, the counter 113 merely determines that two transmissions out of the five total are correct and this indicates a valid transmission to thus enable the updown counter 115 to be set to an opened or closed loop condition.

Module 106 is a signal timing detection circuit. Module 106 monitors the output of the limiter 102 and provides a signal each time there is no received signal during a period of one hundred milliseconds. In this manner, module 106 provides an output signal which immediately resets the counter 113 and the shift register 105. The function of module 106 is to prevent noise or other spurious signals from implementing receiver operation.

As shown in FIG. 4, the nature of the signal is such that once a transmission starts, the transistions occuring for five rounds of the signal occur more frequently than one hundred milliseconds. The longest fixed duration is indicated by the interround delay and the intercode pause which are eighteen milliseconds. Thus, if no signal is received for example, for one hundred milliseconds, then the original triggering signal was improper and the receiver is reset to its initial condition. In this manner, the pause detector 104 will again serve to detect the eighteen millisecond pause and hence, to gate the received information to the shift regisger for purposes of performing an alarm code comparison.

It is, of course, understood that the time delay indicative of signal absence as detected by module 106 can be varied depending upon noise or ambient conditions and hence, module 106 may operate with a fifty millisecond delay and then reset the various units for a signal absence of fifty milliseconds.

It is thus seen that a unique function is provided by the transmission system as described above. Accordingly, the system will operate to continuously monitor openings and closings to keep track of the same by updating the updown counter 115. In this manner, the overall loop condition will be defined at the end of the day when the user sets his alarm system and he can ascertain the condition of the loop upon closing by verifying that the contents of the updown counter are, in fact, indicative of a closed loop signal. Thus, there will be no need to inactivate the transmitter or receiver during normal operating times as the updown counter continuously monitors the loop status and the loop status should indicate the closed loop condition when the security system is placed in operation at the end of the day. Hence, a change in the updown counter from a zero to a one will now activate the alarm circuit 130 when the premises are secured.

It can also be seen that the system described has utility both in burglary and fire detection. The sensor 53 of FIG. 1 can be a temperature sensor or a smoke detector output and these sensors are also monitored by this loop and if they should inadvertently open and not close, this condition will also be detected.

As indicated, the system further has the feature that the condition and status of the battery is constantly monitored and a low battery at a transmitter location will cause a signal to be sent and detected at the receiver location and hence, the system gives a warning of the battery state as well as the opening and closing status of the loop.

The system further operates within the constraints imposed by the FCC in regard to length and duration of transmissions.

The modulation scheme depicted is simple and easy to implement while the length of the bit and the space between bits are the same (six milliseconds). It is also noted that the spacing between bits can be different than the bit length, if so desired. It is also noted that the selection of both the bit length and the duration for the intercode and interround delay can vary, if desired, and hence, one can transmit more or less bits during a given period.

Since the system is completely digital, it is simple to implement the same by the use of large scale integrated circuits or by employing conventional integrated circuit components. This allows for an extremely compact transmitter and receiver assembly and hence, the transmitters as employed in conjunction with doors or windows are relatively small, thus avoiding all difficulties with the aesthetic appearance of the premises to be monitored.

I claim:

1. In a security system of the type employing a transmitter capable of transmitting a signal containing information as to the address code of a secured location by monitoring the opened or closed status of a loop associated with said location and transmitting said signal when the status of said loop changes, said signal containing additional information indicative of the loop status, and a remote receiver capable of receiving said transmitted signal, the combination therewith of apparatus located at said receiver and operative to monitor the total number of loop openings and closings, comprising:

(a) means responsive to said received signal for storing therein said information associated with said address code and said loop status, (b) means for comparing said address code with a predetermined code stored in said receiver and indicative of said transmitter location, to provide a comparison signal when said codes are equivalent, and (c) means responsive to said comparison signal for storing said information indicative of said loop status, said means including a status counter effective to increase the count stored for one loop status and to decrease the count stored for said other loop status, whereby at the end of a desired period, the counter has stored therein the present status of said loop.

2. The security system combination according to claim 1 wherein said means responsive to said received signal includes a shift register responsive to said address code of said signal for storing therein a signal indicative of the information associated with said address code.

3. The security system combination according to claim 1 wherein said means for comparing said address code includes a plurality of selectable switches coupled to said comparator and operative to provide an address code for said comparator indicative of a particular transmitter location and hence, indicative of said secured location.

4. The security system combination according to claim 1 wherein said transmitter is coupled to a battery potential supply for applying operating potential thereto, with said transmitted signal further containing battery information indicative of the value of said battery potential, and means located at said receiver and responsive to said information to provide an indication when said battery information signal indicates a battery level below a predetermined desired potential.

5. An information signaling system for a transmitter and receiver to enable a selected receiver to respond to one of a plurality of transmitters comprising a transmitter capable of transmitting an RF signal containing a binary code and having a first interval indicative of a signal start condition, and followed by a series of pulses and relatively equal time durations with said durations less than said start interval, with certain of said pulses indicative of a binary one containing a higher frequency tone within said time duration, means located at said transmitter for selecting an address code; which code is specified by said series of pulses, a receiver tuned to said RF signal and including means responsive to said start interval to cause said receiver to store said series of pulses, means located at said receiver for selecting said code associated with said transmitter and for comparing said code as selected with said series of pulses as stored to provide an output signal upon a favorable comparison, said receiver including means responsive to said higher frequency tone indicative of said binary one to enable said receiver to store said pulses as a binary code consisting of a series of ones and zeroes.

6. The information signaling system according to claim 5 including a security loop located at said transmitter and operative to monitor the condition of a secured location, said loop including sensing means coupled to said transmitter to provide a first signal indicative of an unsecured condition and a second signal indicative of a secured condition, means coupled to said sensing means to cause said transmitter to transmit said RF signal wherein one of said series of pulses is either at a one or zero depending upon receipt by said transmitter of said first or second signal.

7. The information signaling system according to claim 6, further including means located at said receiver to cause said receiver to store said one pulse indicative of said loop status upon detection of said favorable comparison, and for updating said stored signal for each transmission of said transmitter, whereby at the end of a desired period, said receiver will have stored therein a signal indicative of the number of unsecured loop conditions less the number of secured loop transistions.

8. The information signaling system according to claim 5 including means to cause said transmitter to transmit said signal a number of consecutive times and means responsive to said number of consecutive transmissions to inhibit transmission for a predetermined interval.

9. The information signaling system according to claim 5 wherein said transmitter is biased by a source of potential, means coupled to said source of potential to provide a control signal when said source falls below a desired value for reliable operation, means responsive to said control signal to cause said transmitter to commence transmission of said RF signal wherein one of said pulses is modulated according to said control signal, and means coupled to said receiver for responding to said one pulse to provide an alarm signal indicative of said low potential value.

10. The signaling system according to claim 5 further including signal monitoring means located at said receiver and responsive to monitor the received signal and to provide a disable output signal when a received signal contains no transistions within a predetermined interval greater than said first interval, said disable output signal operative to reset said means responsive to said start signal for storing said series of pulses during the presence of said disable signal.

11. The information signaling system according to claim 8 further including means located at said transmitter and responsive to the loop status at the end of said consecutive number of transmissions, to provide an output signal when the status of said loop has changed during said consecutive transmissions, and means responsive to said output signal to activate said transmitter after said predetermined interval to cause transmission of said RF signal indicative of said loop status change.

12. The information signaling system according to claim 5 wherein means for selecting said address code at said transmitter comprises a bank of single pole, single throw switches, a code generator capable of providing an output series of pulses indicative of said transmitted pulse series, said switches coupled to said code generator for specifying the binary level of each of said pulses according to the setting of said switches.

13. The information signaling system according to claim 5 wherein said means located at said receiver for selecting said code comprises a plurality of two position switches coupled to said comparator.

14. The information signaling system according to claim 5 wherein said receiver includes a shift register for storing said series of pulses, said register having a first input adapted to receive all of said pulses, and a second input adapted to receive those pulses which are indicative of binary one to thereby cause said register to store said pulses as a binary code consisting of a series of ones and zeroes.

* * * * *